US008136473B2

(12) United States Patent
Tsai

(10) Patent No.: US 8,136,473 B2
(45) Date of Patent: Mar. 20, 2012

(54) GLUING MECHANISM AND GLUING METHOD FOR TISSUE PAPER WINDING MACHINE

(75) Inventor: Tung-I Tsai, Taoyuan (TW)

(73) Assignee: Chan Li Machinery Co., Ltd., Taoyuan (TW)

( * ) Notice: Subject to any disclaimer, the term of this patent is extended or adjusted under 35 U.S.C. 154(b) by 1210 days.

(21) Appl. No.: 11/902,767

(22) Filed: Sep. 26, 2007

(65) Prior Publication Data

US 2009/0025863 A1 Jan. 29, 2009

(30) Foreign Application Priority Data

Jul. 27, 2007 (TW) ..... 96127667 A

(51) Int. Cl.
*B05C 1/06* (2006.01)

(52) U.S. Cl. ..... 118/211; 118/212; 242/532.3; 156/578

(58) Field of Classification Search ..... 118/211, 118/212, 249; 242/532.3, 533, 533.1, 542, 242/542.1, 542.2; 156/578; 427/429, 207.1
See application file for complete search history.

(56) References Cited

U.S. PATENT DOCUMENTS

| | | | | |
|---|---|---|---|---|
| 3,552,670 | A * | 1/1971 | Herman | 242/527.1 |
| 5,791,587 | A * | 8/1998 | Pasquale | 242/527.1 |
| 6,308,909 | B1 * | 10/2001 | McNeil et al. | 242/527.4 |
| 6,655,629 | B1 * | 12/2003 | Acciari | 242/533 |

* cited by examiner

*Primary Examiner* — Laura Edwards
(74) *Attorney, Agent, or Firm* — Rosenberg, Klein & Lee

(57) ABSTRACT

A gluing mechanism and method is used to dispense glue onto predetermined positions at a gluing side of a long tape of tissue paper when the tissue paper is feeding through a winding machine. The gluing mechanism includes a glue dispensing roller oriented towards and located at a predetermined distance from the gluing side of the tissue paper; at least one gluing member located near a predetermined feeding path of the tissue paper to orient toward a contact side of the tissue paper opposite to the gluing side, and including a pivot end and an action end. A driving mechanism is connected to the pivot end of the gluing member for driving the gluing member to turn about the pivot end, so as to move the action end of the gluing member to a glue dispensing position oriented toward the glue dispensing roller or away from the glue dispensing position.

6 Claims, 11 Drawing Sheets

GLUING MECHANISM AND GLUING METHOD FOR TISSUE PAPER WINDING MACHINE

FIELD OF THE INVENTION

The present invention relates to a tissue paper winding machine, and more particularly to a gluing mechanism and a gluing method for tissue paper winding machine.

BACKGROUND OF THE INVENTION

In a conventional tissue paper winding machine, a core is generally sent by a conveyor to a first winding roller and pushed by a core inserter into a curved guiding passage to a winding nip, at where a long tape of tissue paper is wound around the core to form a paper log, such as a rolled tissue paper. During the winding process, a leading edge and a trailing edge of the tissue paper are separately applied with an amount of initial glue and tail glue by way of transfer or using a rotation disc to transfer the glue from the glue tank to the tissue paper.

The rewinding machine with gluing device disclosed in WO 2004/046006 includes a gluing applicator having a glue tank inside which a pick-up roller rotates, partially immersed in the glue contained in the tank. The pads carried at the ends of the teeth or slats forming severing means are driven into contact with the glue applicator and soaked with glue. When the pad is pressed against the web material, it applies to it part of the glue with which it is impregnated. Consequently, a broken longitudinal band of glue is applied along the cross-wise extension of the web material.

In the case of applying glue on the tissue paper via transfer, there is often a problem of insufficient or uneven application of glue. And, in the case of applying glue with a rotation disc, the glue tends to be centrifugally thrown off the rotation disc when the latter rotates at a high speed, and subsequently only a small amount of glue is applied onto the tissue paper.

SUMMARY OF THE INVENTION

It is therefore a primary object of the present invention to provide a gluing mechanism for tissue paper winding machine, so that a glue is always sufficiently and uniformly applied to the tissue paper.

Another object of the present invention is to provide a gluing mechanism for tissue paper winding machine, with which the tissue paper is applied at predetermined positions with a glue via at least one gluing member that does not directly contact the glue.

A further object of the present invention is to provide a gluing mechanism for tissue paper winding machine having at least one gluing member that allows easy adjustment of a distance between the initial glue and the tail glue respectively applied to the tissue paper at a leading edge and at a trailing edge.

A still further object of the present invention is to provide a method of dispensing glue to a tissue paper by a tissue paper winding machine.

To fulfill the above objects, the present invention provides a gluing mechanism and method for dispensing a glue onto predetermined positions at a gluing side of a long tape of tissue paper when the tissue paper is feeding through a winding machine. The gluing mechanism includes a glue dispensing roller oriented towards and located at a predetermined distance from the gluing side of the tissue paper; at least one gluing member located near a predetermined feeding path of the tissue paper to orient towards a contact side of the tissue paper opposite to the gluing side, and including a pivot end and an action end. A driving mechanism is connected to the pivot end of the gluing member for driving the gluing member to turn about the pivot end, so as to move the action end of the gluing member to a glue dispensing position oriented toward the glue dispensing roller or away from the glue dispensing position.

With the gluing mechanism and method for tissue paper winding machine according to the present invention, glue may be sufficiently, stably, and evenly applied to predetermined positions on a long tape of tissue paper being wound on a winding machine. In the gluing mechanism of the present invention, the tissue paper is passing through a space between a glue dispensing roller and at least one gluing member, and is pushed by the gluing member to touch the glue dispensing roller. Physically, the gluing member itself is not in contact with the glue, and the amount of glue applied onto the tissue paper is not affected by a turning speed of the gluing member. The gluing mechanism of the present invention also includes a driving mechanism for controlling the turning speed of the gluing member, so as to adjust the distance between the initial glue and the tail glue on the tissue paper. The driving mechanism drives the gluing member to turn in a predetermined rotation mode, so that the gluing member and the tissue paper contact with each other at a synchronized speed to avoid the generation of a tearing force that would break the tissue paper, and to increase the good yield of the tissue paper winding machine.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
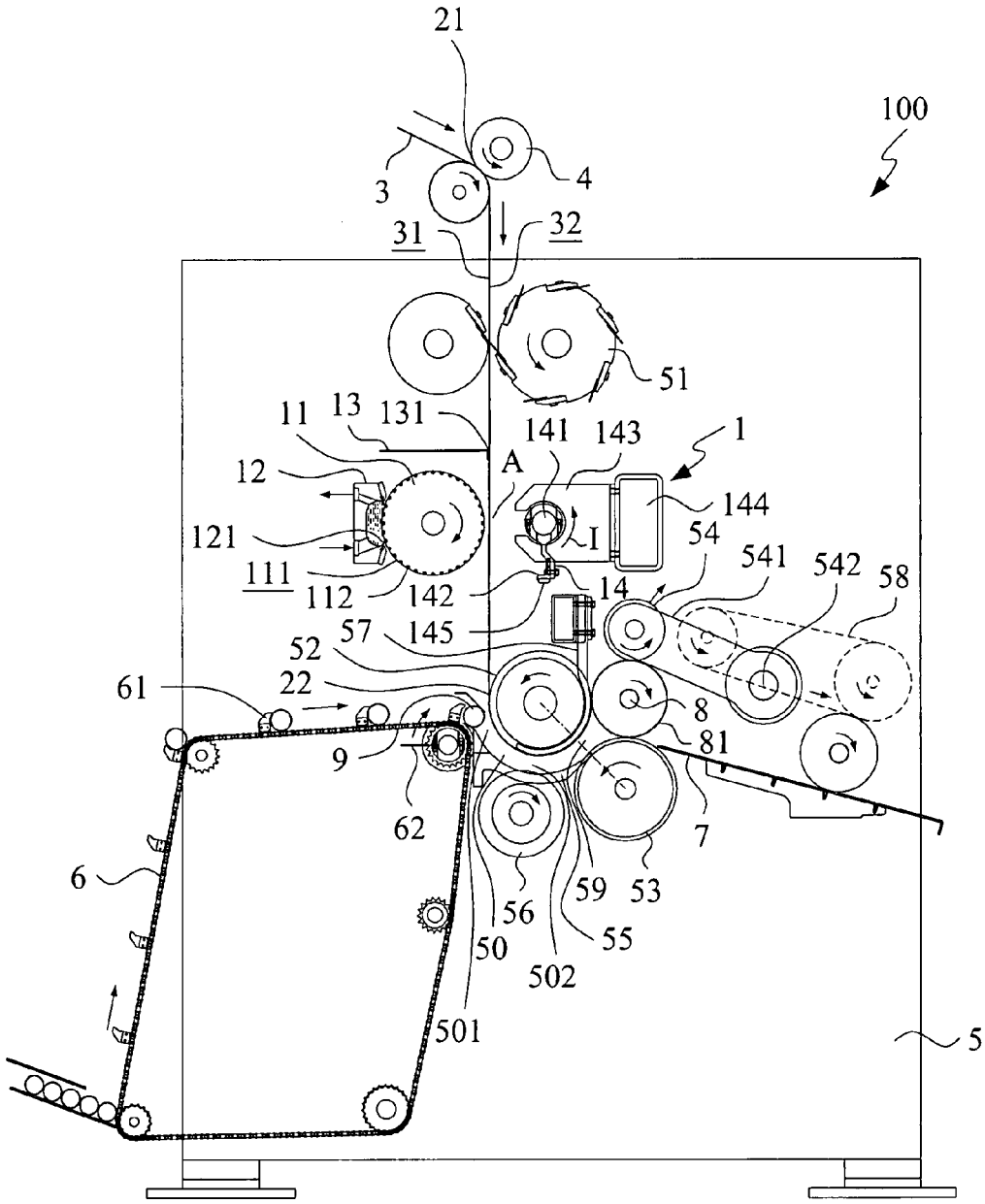
FIG. 1 is a schematic side view showing a tissue paper winding machine having a gluing mechanism constructed in accordance with the present invention.
Figure 2:
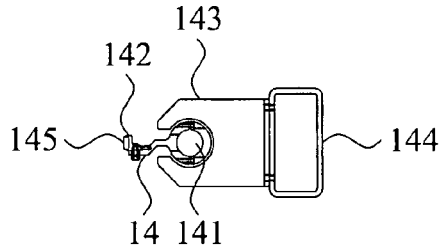
FIG. 2 is a side view showing a gluing member of the gluing mechanism of the present invention.
Figure 3:
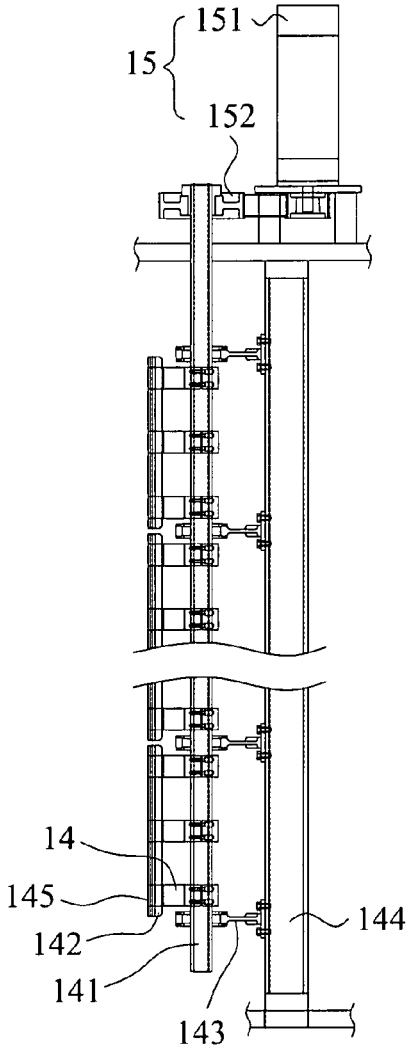
FIG. 3 is a top plan view showing the gluing member of FIG. 2 connected to a driving mechanism.

Please refer to FIG. 1 that is a side view showing a tissue paper winding machine 100 having a gluing mechanism 1 constructed in accordance with the present invention. When a long tape of tissue paper 3 is continuously fed to the winding machine 100 along a predetermined feeding path (not labeled), via an inlet end 21 to an outlet end 22, a glue is dispensed at predetermined positions on a gluing side 31 of the tissue paper 3 using the gluing mechanism 1.

The tissue paper winding machine 100 includes a pair of feed rollers 4, a machine frame 5, a perforation roller 51, a first winding roller 52, a second winding roller 53, a rider roller 54, a plurality of core support plates 55 (only one can be seen in the figure), a pinch roller 56, a plurality of arms 57 (only one can be seen in the figure), a belt 58, a conveyor 6, and a chute 7. The first winding roller 52 and the core support plates 55 together define a channel 50 between them. The channel 50 has a loading nip 501 and a narrowed passage 502. The arms 57 are downward extended to a lower surface of the first winding roller 52, each of which is provided with a protuberance (not labeled) that makes the channel 50 becomes narrowed.

Please refer to FIGS. 1, 2, 3, and 4 at the same time. The gluing mechanism 1 includes a glue dispensing roller 11, a glue tank 12 having an amount of glue contained therein, a fender 13, a plurality of gluing members 14, and a driving mechanism 15. As it can be seen from FIG. 4, the circumferential surface of the glue dispensing roller 11, that is adjacent to the glue tank 12, dips in the glue tank 12, while the circumferential surface of the glue dispensing roller 11 at the opposite side faces toward and keeps at a predetermined distance from the gluing side 31 of the tissue paper 3. The glue dispensing roller 11 has a roller surface 111, on which a mesh 112 with a plurality of tiny holes is arranged. The glue tank 12 is located in the vicinity of the glue dispensing roller 11. When the glue dispensing roller 11 is rotated about its axis to dip into the glue tank 12, the glue is adhered to and trapped in the tiny holes of the mesh 112, so that the entire roller surface 111 of the glue dispensing roller 11 is coated with the glue. The glue tank 12 further includes at least one scraper 121 (two scrapers 121 are shown in the illustrated embodiment) for scraping surplus glue off the roller surface 111 of the glue dispensing roller 11.

The fender 13 is located near and above the glue dispensing roller 11 with one end 131 in light contact with the tissue paper 3, such that a predetermined space is normally kept between the glue dispensing roller 11 and the gluing side 31 of the tissue paper 3 to prevent the tissue paper 3 having glue dispensed thereon from adhering to the glue dispensing roller 11.

The gluing members 14 are located at a predetermined position near the feeding path of the tissue paper 3, and facing toward a contact side 32 of the tissue paper 3 opposite to the gluing side 31. Each of the gluing members 14 includes a pivot end 141 and an action end 142, and is connected at the pivot end 141 to a horizontal bar 144 via a plurality of supporting brackets 143, while the horizontal bar 144 is fixed to the machine frame 5. An elastic pad 145 is mounted to the action end 142 of the gluing member 14.

The driving mechanism 15 is connected to the pivot ends 141 of the gluing members 14 for driving the gluing members 14 to turn about the pivot ends 141 either in a first rotation direction I or in a direction reverse to the first rotation direction I, so that the action ends 142 of the gluing members 14 may be moved to a glue dispensing position A oriented towards the glue dispensing roller 11, or away from the glue dispensing position A. When the gluing members 14 are turned to the glue dispensing position A, the action ends 142 are driven to lightly touch the roller surface 111 of the glue dispensing roller 11. The driving mechanism 15 includes a motor 151 and a transmission means 152.

A winding nip 59 is defined between the first winding roller 52, the second winding roller 53, and the rider roller 54. The tissue paper 3 having a predetermined thickness and width is fed to the winding machine 100 via the feed rollers 4, and is moved through the perforation roller 51 to be perforated. Then, the tissue paper 3 is moved to bear against the lower circumferential surface of the first winding roller 52, so as to be wound around a first core 8 located in the winding nip 59 to thereby form a roll of paper 81 having a predetermined diameter, such as a roll of toilet paper. The perforation roller 51 is located near and above the first winding roller 52 to form a line of perforation across the tissue paper 3 at fixed intervals.

Figure 4:
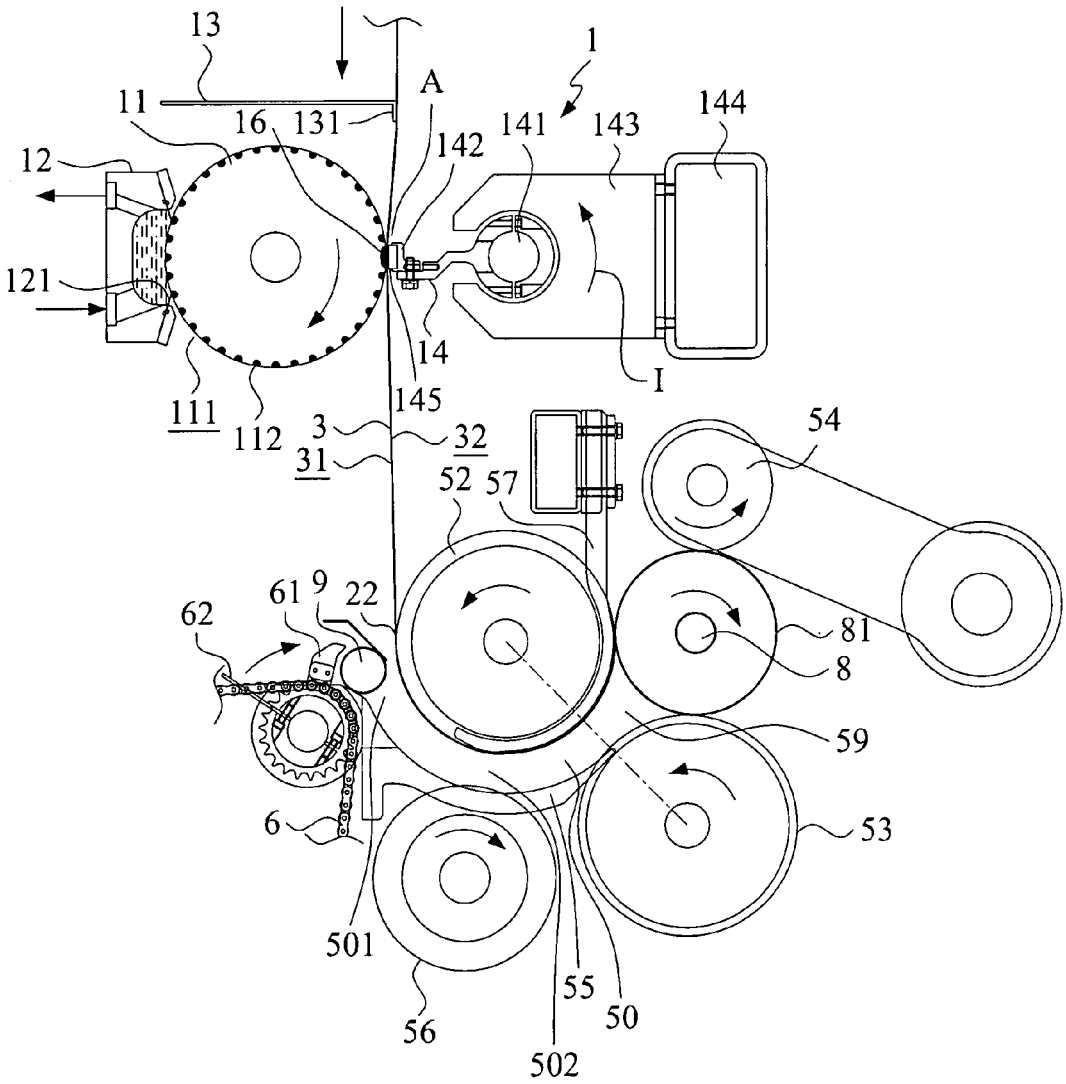
FIG. 4 schematically shows an action end of the gluing member is located at a glue dispensing position for pushing the tissue paper against a glue dispensing roller, so that an amount of tail glue is applied on the tissue paper.

The tissue paper 3 is moved along the predetermined feeding path between the glue dispensing roller 11 and the gluing members 14. When the winding of the roll paper 81 on the first core 8 is about to complete, the gluing members 14 are driven by the driving mechanism 15 to turn, bringing the action ends 142 to locate at the glue dispensing position A. At this point, the tissue paper 3 passing through between the glue dispensing roller 11 and the gluing members 14 is lightly pushed by the action ends 142 of the gluing members 14 against the roller surface 111 of the glue dispensing roller 11, so that the glue on the roller surface 111 is dispensed onto the gluing side 31 of the tissue paper 3 to provide an amount of tail glue 16 thereon, as shown in FIG. 4. The tail glue 16 adheres to the roll of paper 81 later to complete the winding of the core and forms a completed rolled paper 81.

Figure 5:
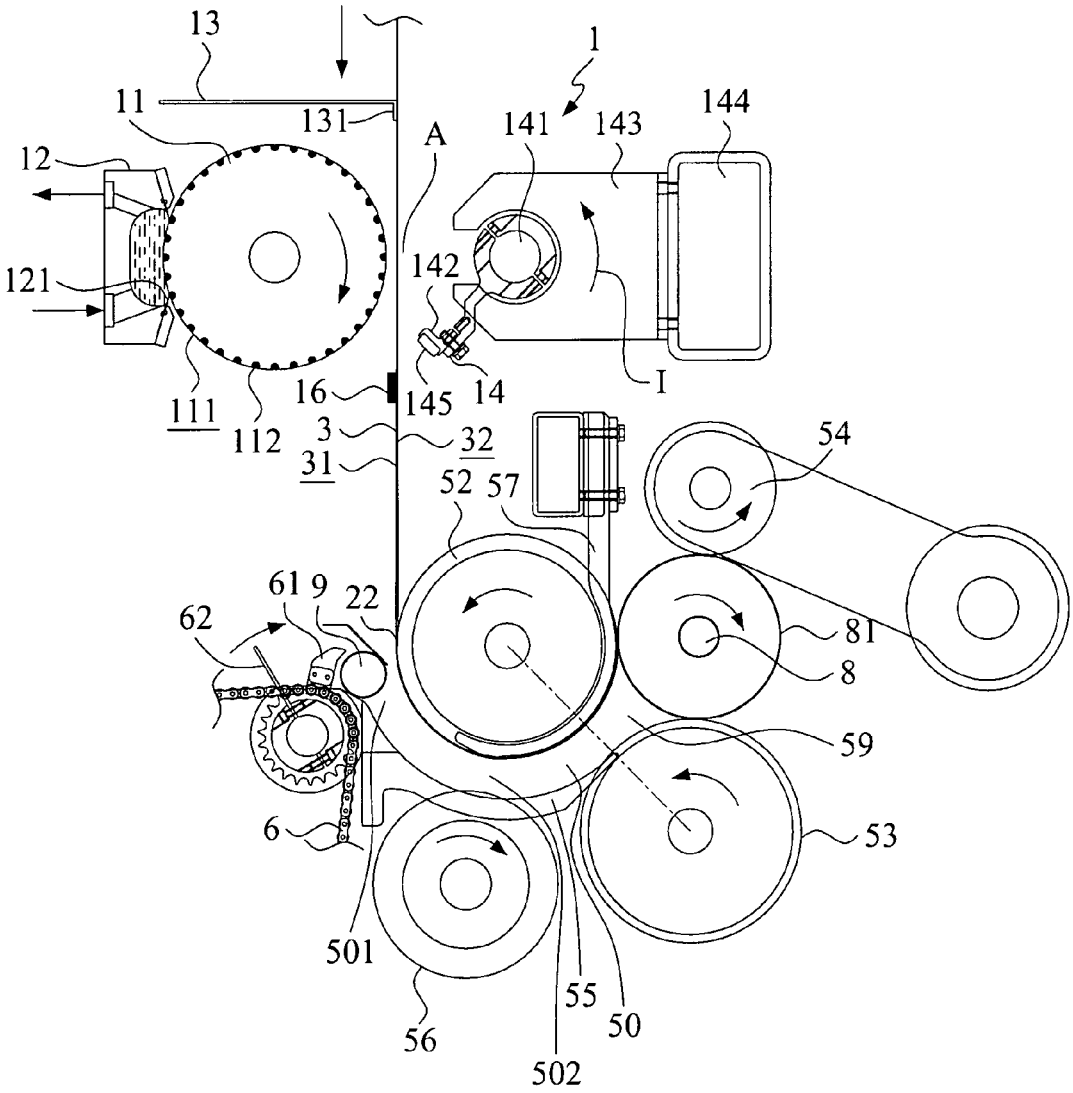
FIG. 5 shows the action end of the gluing member is moved away from the glue dispensing position after the tail glue has been applied on the tissue paper.
Figure 6:
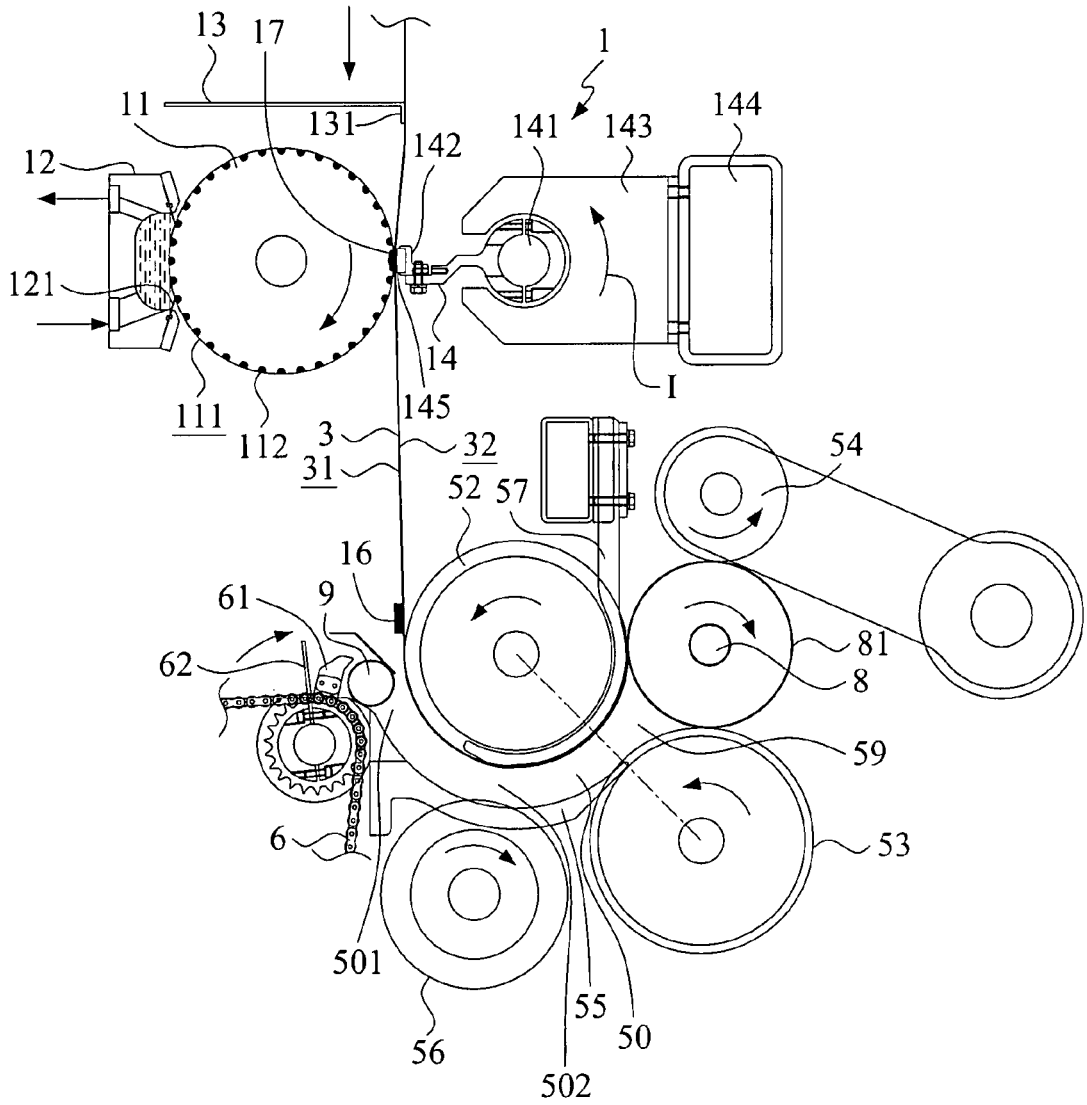
FIG. 6 shows the action end of the gluing member is located at the glue dispensing position again for pushing the tissue paper against the glue dispensing roller, so that an amount of initial glue is applied on the tissue paper.
Figure 7:
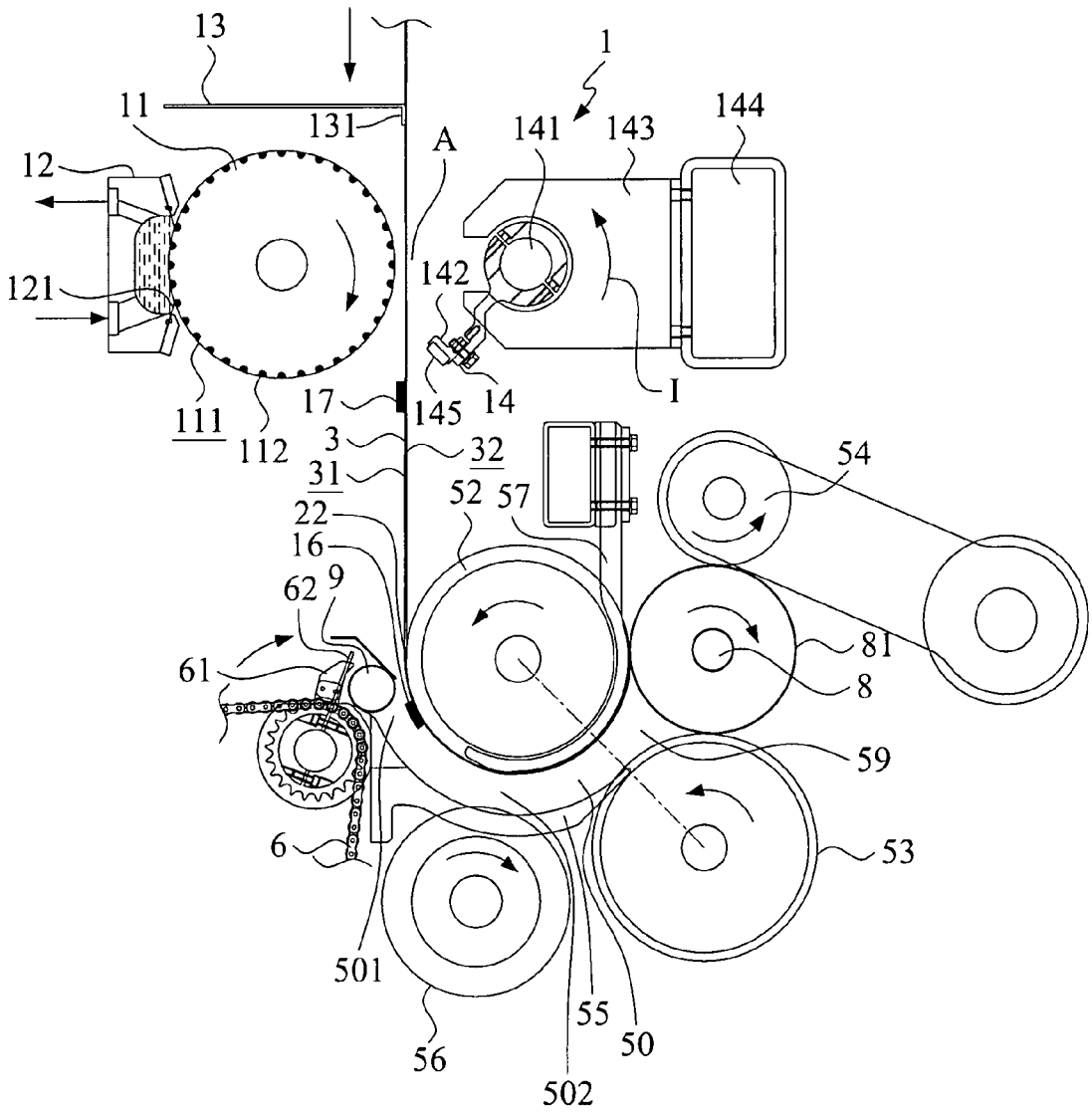
FIG. 7 shows the action end of the gluing member is moved away from the glue dispensing position after the initial glue has been applied on the tissue paper.

After the tail glue 16 is provided on the gluing side 31, the tissue paper 3 is further moved along the predetermined feeding path, as shown in FIG. 5. Meanwhile, the gluing members 14 are driven by the driving mechanism 15 to turn the action ends 142 one circle to the glue dispensing position A again, so that the glue is dispensed from the glue dispensing roller 11 onto the gluing side 31 of the tissue paper 3 to provide an amount of initial glue 17 thereon, as shown in FIG. 6. Then, the tissue paper 3 is further moved along the predetermined feeding path, as shown in FIG. 7. The tissue paper 3 is adhered to a second core 9 by the initial glue 17 later.

With the above-described gluing mechanism, the gluing members 14 do not contact with the glue in the process of dispensing glue onto the tissue paper 3, and there is always sufficient and evenly distributed glue on the roller surface 111 of the glue dispensing roller 11 for dispensing. The amount of glue dispensed onto the tissue paper 3 is not affected by a turning speed of the gluing members 14. The distance between the tail glue 16 and the initial glue 17 may be adjusted by controlling the turning speed of the gluing members 14.

Figure 8:
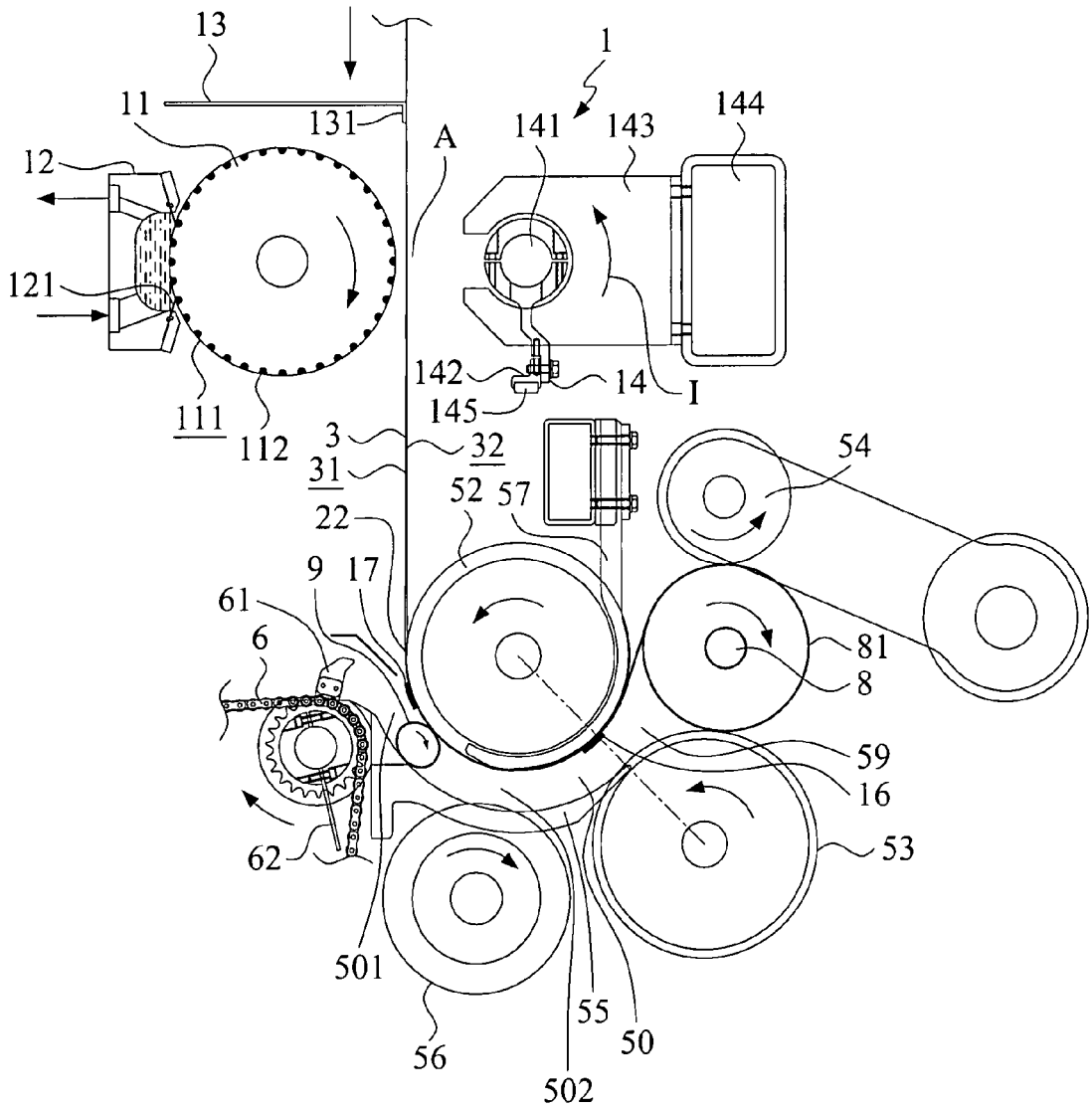
FIG. 8 shows a second core is pushed into a channel.

The second core 9 is carried by one of many core carriers 61 of the conveyor 6 to the loading nip 501 of the channel 50 formed between the first winding roller 52 and the core support plates 55. At this point, a core inserter 62 of the conveyor 6 is automatically turned to push the second core 9 into the channel 50, as shown in FIGS. 7 and 8. Then, the second core 9 is driven by the first winding roll 52 to roll forward along the channel 50.

Figure 9:
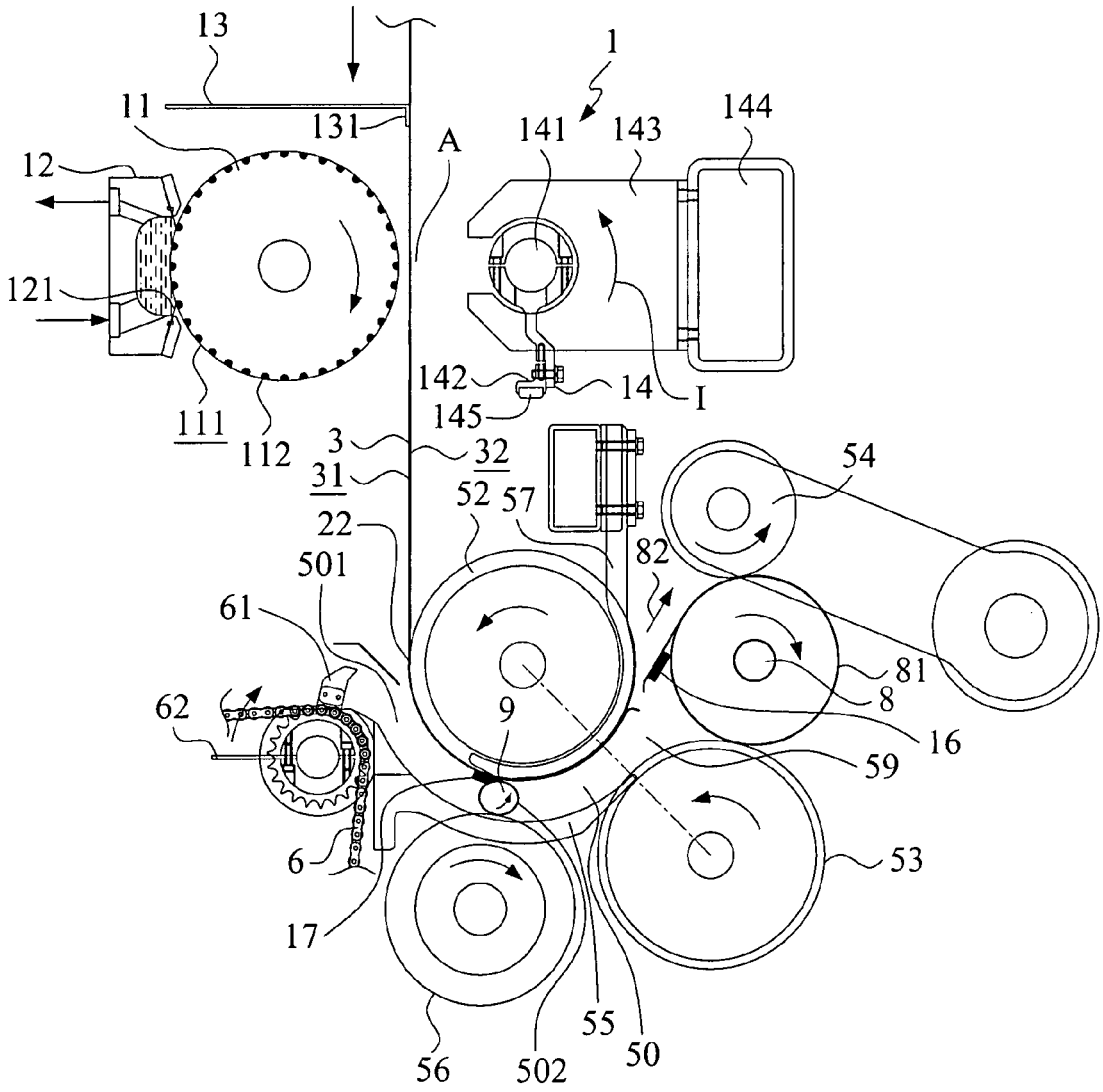
FIG. 9 shows the tissue paper is pulled apart.

Please refer to FIG. 9. When it rolls to the narrowed passage 502 between the first winding roller 52 and the pinch roller 56, the second core 9 is on the one hand hindered by the narrowed passage 502, and on the other hand kept driven by a roller surface of the pinch roller 56 to rotate. Meanwhile, the tissue paper 3 is clamped between the second core 9 and the protuberances of the arms 57. However, the rolled paper 81 formed by the tissue paper 3 wound around the first core 8 is kept rolling to produce a pulling force 82 against the tissue paper 3, pulling and breaking the tissue paper 3 between the first core 8 and the second core 9, to form a trailing edge at the tissue paper 3 of the winding core 8 and a new leading edge at the feeding tissue paper 3.

Figure 10:
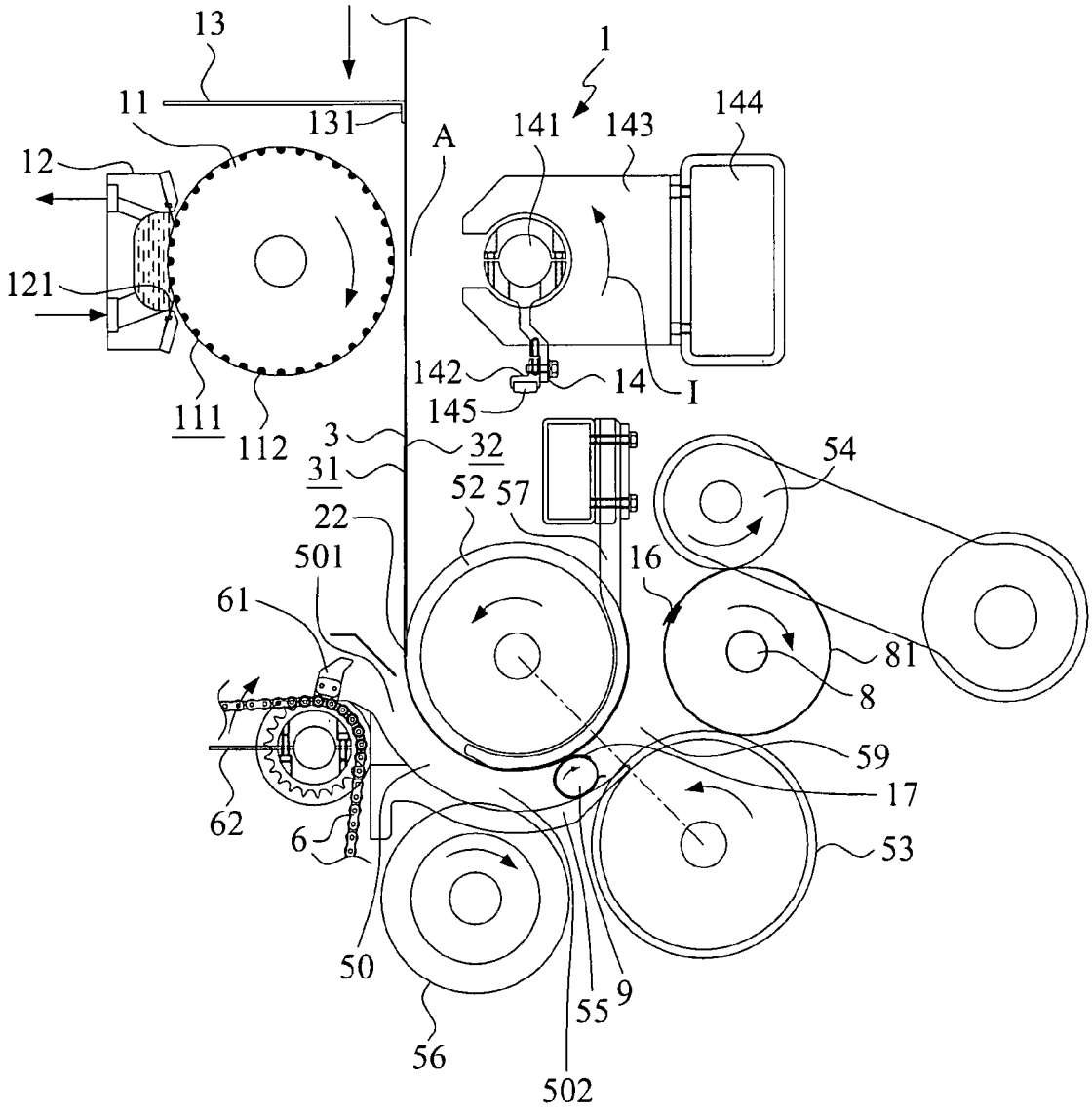
FIG. 10 shows a leading edge of the torn tissue paper is adhered to the second core by the initial glue.
Figure 11:
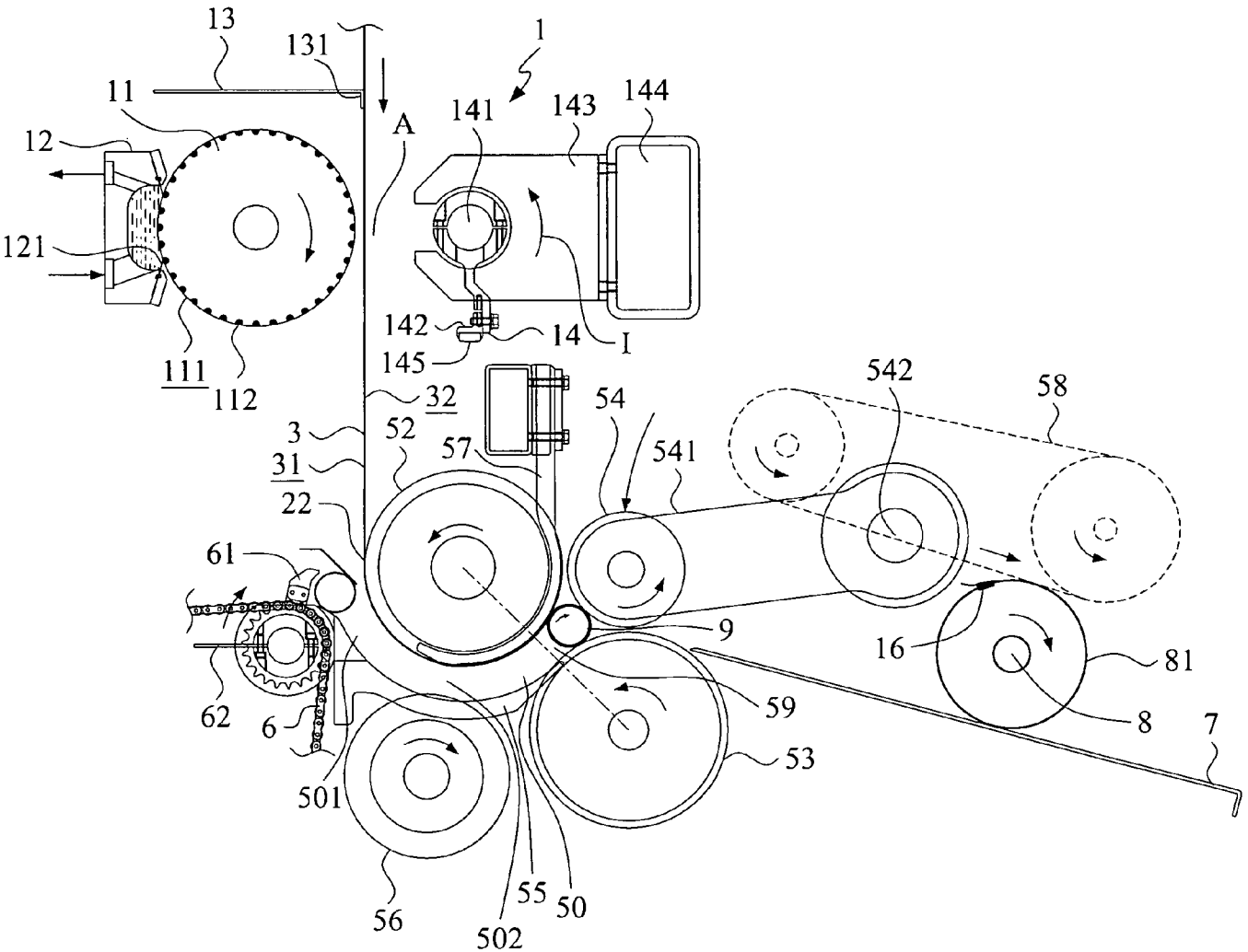
FIG. 11 shows the second core is moved into a winding nip while a completed rolled tissue is delivered from the tissue paper winding machine.

Please refer to FIGS. 10 and 11. When the second core 9 has passed through the narrowed passage 502, it is driven by the first winding roller 52 to rotate clockwise and roll forward. At this point, the initial glue 17 on the tissue paper 3 is adhered to the second core 9, as shown in FIG. 10. Then, the second core 9 is transferred to the winding nip 59 due to an effect of speed difference between the first winding roller 52 and the second winding roller 53 caused by a speed reduction of the second winding roller 53, and the winding of the long tape of tissue paper 3 around the second core 9 is started. Meanwhile, the completed rolled paper 81 formed on the first core 8 is moved along the chute 7 and the belt 58 and discharged from the winding machine 100, as shown in FIG. 11.

The rider roller 54 is connected to an oscillable gripping arm 541. When the oscillable gripping arm 541 is oscillated about a rotary shaft 542 thereof, the rider roller 54 connected to the oscillable gripping arm 541 is driven to move upward and downward along an oscillating orbit (not shown) of the oscillable gripping arm 541. Please refer to FIG. 11. When the rolled paper 81 has been discharged, the rider roller 54 initially pressing against the rolled paper 81 would move downward to press against the second core 9.

Figure 12:
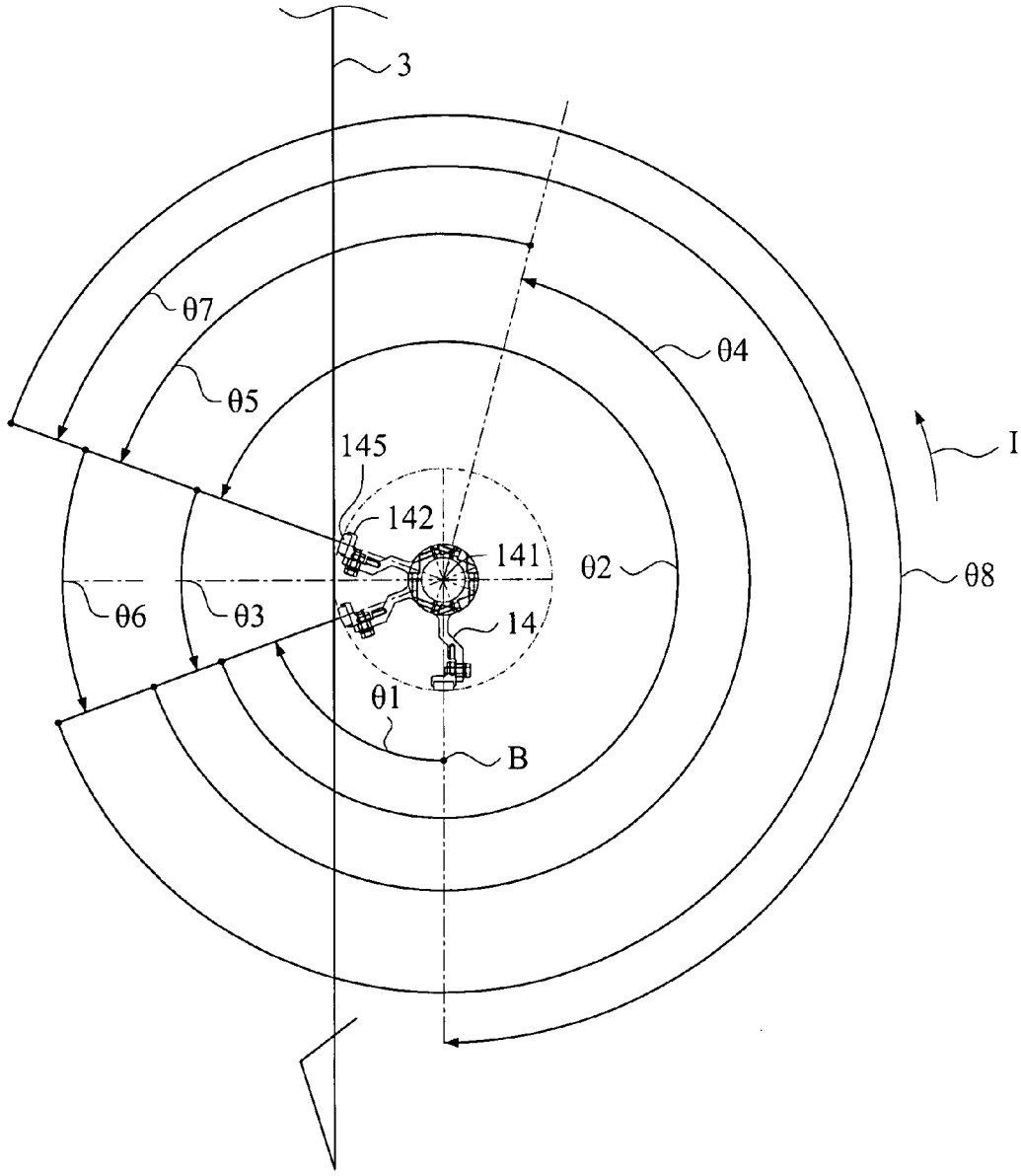
FIG. 12 is a schematic view showing the operation of the gluing member of the gluing mechanism in one working cycle.

FIG. 12 is a schematic view showing the operation of the gluing members 14 of the gluing mechanism 1 in one working cycle. During the process of dispensing the glue onto the gluing side 31 to provide the tail glue 16 and the initial glue 17 on the tissue paper 3, the driving mechanism 15 drives the gluing members 14 to turn in a predetermined rotation mode, so that the action ends 142 of the gluing members 14 are displaced to a glue dispensing position (that is, a horizontal position A) oriented to the glue dispensing roller 11 to contact with the contact side 32 of the tissue paper 3. At this point, the tissue paper 3 passing through between the glue dispensing roller 11 and the gluing members 14 is pushed by the action ends 142 of the gluing members 14 against the roller surface 111 of the glue dispensing roller 11, so that the glue on the roller surface 111 is dispensed onto the gluing side 31 of the tissue paper 3.

The rotation pathway in which the gluing members 14 are driven by the driving mechanism 15 to go through is now described with reference to FIG. 12. Originally, the gluing members 14 are located at an initial position B. For the gluing members 14 to have sufficient acceleration time, the driving mechanism 15 first drives the gluing members 14 to turn an angle θ1 in a direction reverse to the first rotation direction I. Then, the driving mechanism 15 drives the gluing members 14 to turn an angle θ2 in the first rotation direction I to accelerate, so that the gluing members 14 reaches a speed same as the feeding speed of the tissue paper 3. The gluing members 14 keep turning for an angle θ3 at this synchronized speed to get a first contact with the tissue paper 3, so that the tail glue 16 is applied on the tissue paper 3 (please see FIG. 4). The gluing members 14 and the tissue paper 3 contact with each other while they are moving at the same speed, and there is no difference in speed. Accordingly, the invention avoids the generation of any tearing force that would apply to the tissue paper 3 whenever a difference of speed exists, and it eliminates the problem of breaking the tissue paper 3 at the contact position.

Thereafter, the gluing members 14 are driven by the driving mechanism 15 to turn an angle θ4 in the first rotation direction I and accelerate. Then, the gluing members 14 keep turning an angle θ5 in the first rotation direction I and are decelerated to a speed finally synchronize with the feeding speed of the tissue paper 3. The gluing members 14 keep turning an angle θ6 at this synchronized speed to get contact with the tissue paper 3 for a second time, so that the initial glue 17 is applied on the tissue paper 3 as shown in FIG. 6.

Thereafter, the gluing members 14 are driven to turn an angle θ7 in the first rotation direction I and decelerate until they stop moving. Finally, the gluing members 14 are driven to turn an angle θ8 in a direction reverse to the first rotation direction I back to the initial position B to complete one operation cycle thereof.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A gluing mechanism for a tissue paper winding machine for dispensing glue onto predetermined positions at a gluing side of a continuous long tape of tissue paper feeding via an inlet end and moved along a predetermined feeding path towards an outlet end; the gluing mechanism comprising:

a glue dispensing roller having a roller surface adapted to evenly catch a sufficient amount of glue thereto; the glue dispensing roller being located at a predetermined distance from the gluing side of the tissue paper;

at least one gluing member being located near the predetermined feeding path of the tissue paper to orient towards a contact side of the tissue paper opposite to the gluing side; and the gluing member including a pivot end and an action end, the gluing member having an elastic pad mounted to the action end thereof; and a driving mechanism connected to the pivot end of the gluing member for driving the gluing member to turn about the pivot end, so that the action end of the gluing member is moved to a glue dispensing position oriented towards the glue dispensing roller or away from the glue dispensing position;

whereby when the tissue paper is moved from the inlet end of the winding machine along the predetermined feeding path between the glue dispensing roller and the gluing member, the gluing member is driven by the driving mechanism to turn the action end of the gluing member to the glue dispensing position, so that the tissue paper passing through between the glue dispensing roller and the gluing member is pushed by the action end to touch the roller surface of the glue dispensing roller, and an amount of glue is dispensed from the roller surface onto the gluing side of the tissue paper.

2. The gluing mechanism as claimed in claim 1, further comprising a glue tank having an amount of glue contained therein and located near the glue dispensing roller; whereby when the glue dispensing roller rotates, the glue in the glue tank is attached to the roller surface of the glue dispensing roller.

3. The gluing mechanism as claimed in claim 2, wherein the glue tank further includes at least one scraper for scraping surplus glue off the roller surface of the glue dispensing roller.

4. The gluing mechanism as claimed in claim 1, wherein the glue dispensing roller is provided with a mesh formed of a plurality of tiny holes and the glue on the glue dispensing roller is caught in the tiny holes.

5. The gluing mechanism as claimed in claim 1, further comprising a fender located near and above the glue dispensing roller with an end of the fender in light contact with the gluing side of the tissue paper, such that a predetermined space is normally kept between the glue dispensing roller and the gluing side of the tissue paper to prevent the tissue paper having glue dispensed thereon from adhering to the glue dispensing roller.

6. The gluing mechanism as claimed in claim 1, wherein when the gluing member is driven by the driving mechanism to turn the action end to the glue dispensing position, the gluing member has a speed same as a feeding speed of the tissue paper.

* * * * *